United States Patent [19]

Kastl et al.

[11] Patent Number: 4,972,220

[45] Date of Patent: Nov. 20, 1990

[54] SUPPLY ARRANGEMENT FOR SUPPLYING TREATMENT LIQUIDS TO WET TREATMENT DEVICE

[75] Inventors: Alfons Kastl, Munich; Walter Kohlbauer, Kaufbeuren; Franz Kocourek, Munich; Werner Ihm, Isen, all of Fed. Rep. of Germany

[73] Assignee: Agfa-Gevaert AG, Leverkusen, Fed. Rep. of Germany

[21] Appl. No.: 431,919

[22] Filed: Nov. 6, 1989

[30] Foreign Application Priority Data

Nov. 25, 1988 [DE] Fed. Rep. of Germany ..... 3839845

[51] Int. Cl.[5] ..... G03D 3/06

[52] U.S. Cl. ..... 354/324; 354/322

[58] Field of Search ..... 354/320, 321, 322, 324

[56] References Cited

U.S. PATENT DOCUMENTS 3,747,499 7/1973 Foster ..... 354/322
3,833,918 9/1974 Stievenart et al. ..... 354/321
4,806,962 2/1989 Uchida et al. .

FOREIGN PATENT DOCUMENTS 2143158 3/1972 Fed. Rep. of Germany .
8620048 7/1987 Fed. Rep. of Germany .

*Primary Examiner*—A. A. Mathews
*Attorney, Agent, or Firm*—Michael J. Striker

[57] ABSTRACT

A supply arrangement for supplying several treatment liquids to a wet treatment device for photographic material provided with a plurality of treatment tanks having connection openings, the supply arrangement comprises a plurality of supply pipes each connectable with a respective one of the supply openings of the treatment tanks, a plurality of aspiration pumps each connected with a respective one of the supply pipes, a single electric motor which drives the aspiration pumps, and a plurality of aspiration conduits connected to the pumps and each extending outside so as to be each connectable to a respective one of a supply container for treatment liquid.

11 Claims, 2 Drawing Sheets

SUPPLY ARRANGEMENT FOR SUPPLYING TREATMENT LIQUIDS TO WET TREATMENT DEVICE

BACKGROUND OF THE INVENTION

The present invention relates to a supply arrangement for supplying several treatment liquids to a wet treatment device for photographic material.

More particularly it relates to such a supply arrangement which is used for a wet treatment device having a plurality of treatment tanks or chambers through which the material is to be transported, wherein the tanks or chambers are filled through associated connection pipes or openings, and a discharge is provided for the treatment liquid. In such devices supply containers can be connected with the connection pipes or openings.

Wet treatment devices of the above mentioned general type are known. Some of such devices are disclosed for example in the German documents DE-AS No. 2,143,158 and DE-GMS No. 8,620,048. In many instances the quantity of the material to be developed is so great that the canister-like supply containers must be exchanged very frequently. As a result, a great number of supply containers has to be stored on the one hand, and an excessive labor of the operational personnel is required on the other hand.

SUMMARY OF THE INVENTION

Accordingly, it is an object of the present invention to provide an arrangement for supplying treatment liquids in wet treatment devices, which avoids the disadvantages of the prior art.

In keeping with these objects and with others which will become apparent hereinafter, one feature of the present invention resides, briefly stated, in a supply arrangement having a plurality of supply pipes connectable with the connecting opening of the respective tanks, a plurality of aspiration pumps arranged in each of the supply pipes, a single electric motor for driving all aspiration pumps, and aspiration conduits connected to the aspiration pumps and extending outside of the supply arrangement so as to be connected with respective supply containers accommodating treatment liquid.

When the arrangement is designed in accordance with the present invention, the frequent required exchanges of canister-type supply containers for great size tanks to supply fresh treatment liquids is no longer needed, the arrangement can be easily connected with the wet treatment device and supply the liquids into it.

Another feature of the present invention is that the supply pipes of the supply arrangement and the connection openings of the treatment device have such a spatial position on the lower side or plate of the arrangement or on the upper side of the treatment device, and the diameters of the supply pipes are smaller than the diameters of the corresponding connection openings, so that each supply pipe can be engaged in the respective connection opening upon placing of the supply arrangement on the development device.

Another feature of the present invention is that measuring probes for determining a filling condition of the tank are provided in the supply pipes and extend outwardly beyond the lower side of the arrangement, and a supply conduit is provided to extend to each associated aspiration pump.

In accordance with a further feature of the present invention, the measuring probes, a switch for the electric motor and a further main motor switch actuatable upon placing of the supply arrangement on the device are connected with a control unit so that upon sinking the liquid level in one of the tanks under the level of the associated measuring probes, the electric motor is turned on.

In accordance with still a further feature of the present invention, the aspiration pumps are formed as diaphragm pumps arranged on a holder, and the electric motor rotates the eccentric cams which activate spring-loaded working plungers of the aspiration pumps.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
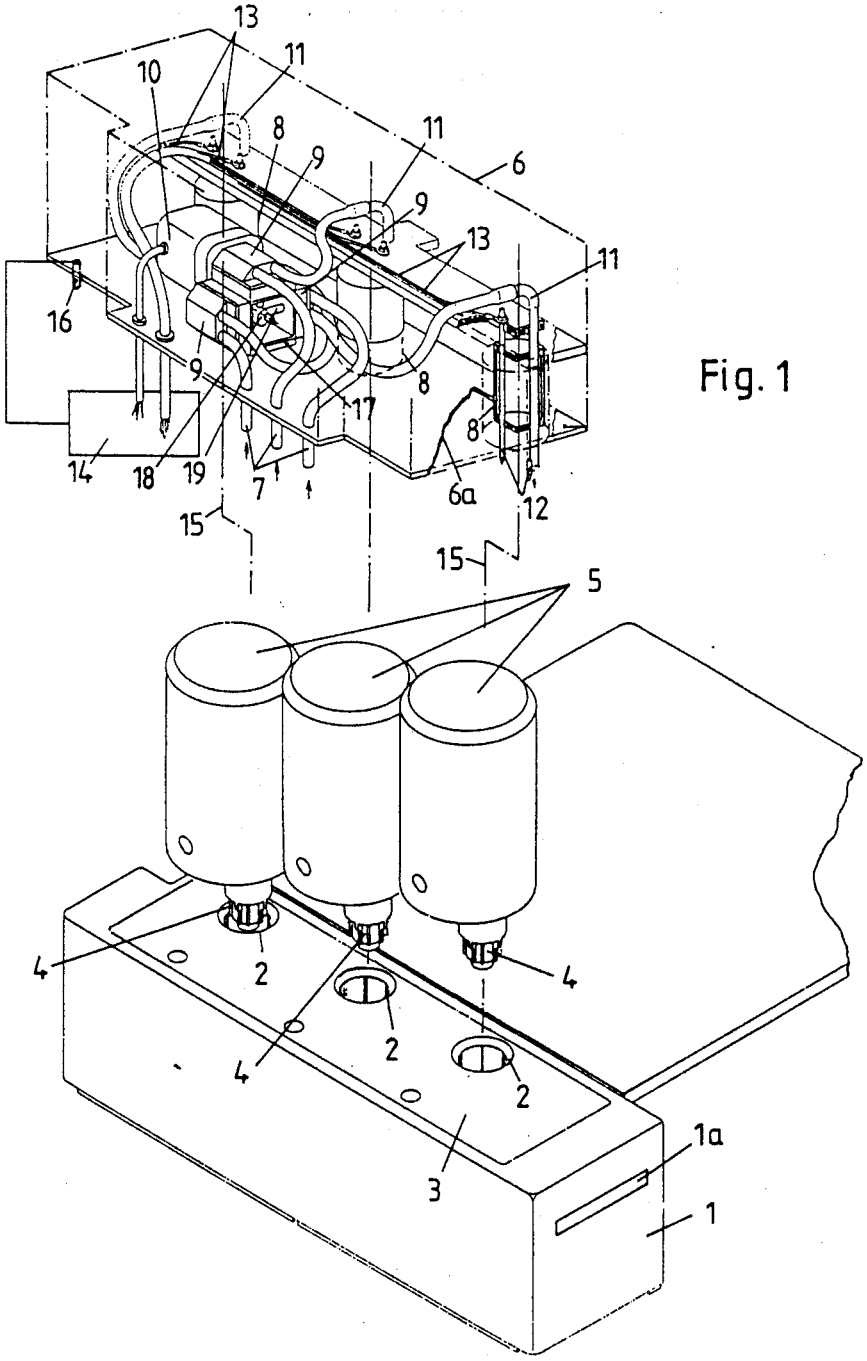
FIG. 1 is a perspective view showing a known wet treatment device in connection with a supply arrangement in accordance with the present invention for supplying treatment liquids.
Figure 2:
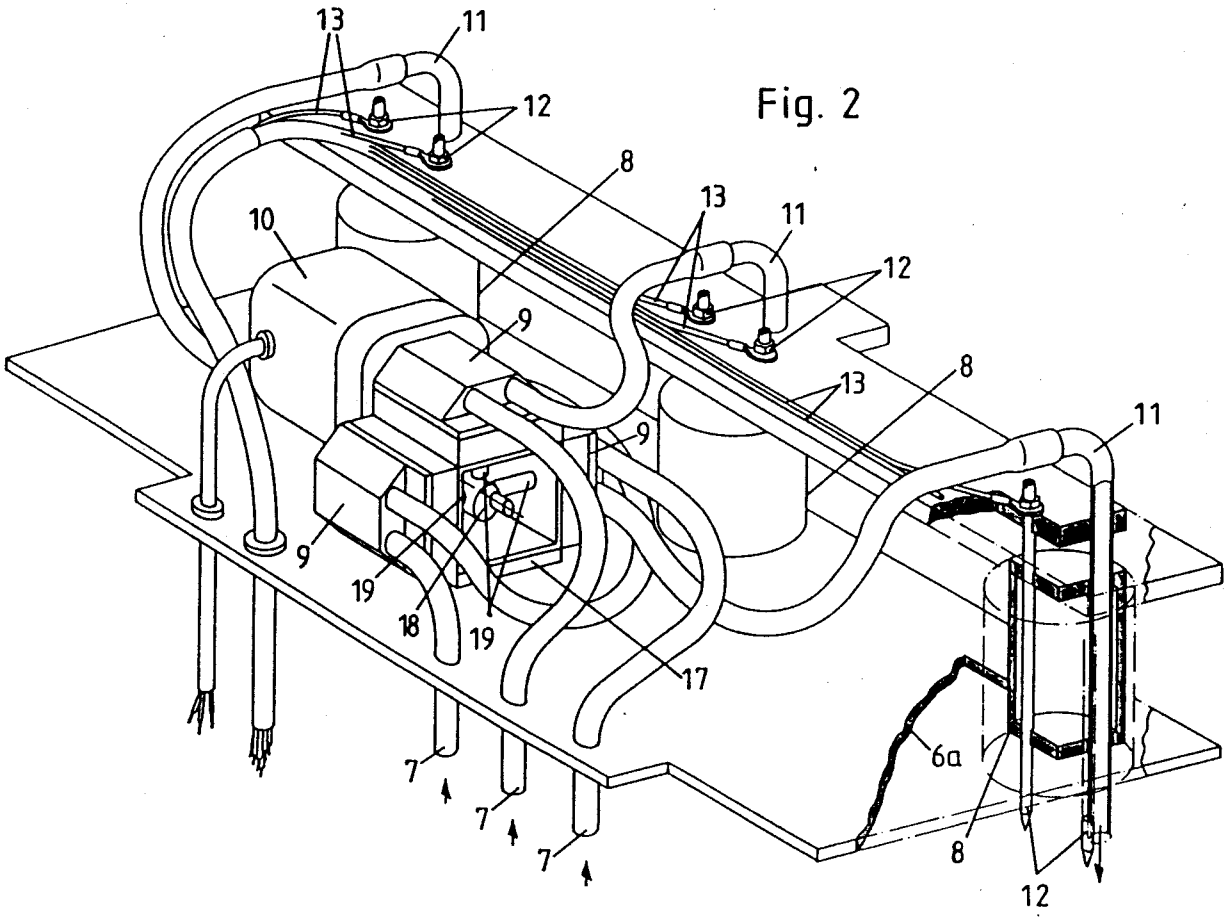
FIG. 2 is a view showing the inventive supply arrangement on an enlarged scale.

A Wet developing device of a known construction is schematically identified in FIG. 1 as a housing 1. It has an outlet slot 1*a* for the developed photographic material. The inlet slot for the material to be treated, located in the housing wall which is opposite to the outlet slot 1*a* is not shown in the drawings.

The device 1 is provided with three not shown development tanks or chambers, namely for the development, fixing and watering, and further with a not shown drying arrangement as well as with known but also not shown recovery means for the treatment baths accommodated in the chambers. When needed, naturally more than three tanks or chambers can be provided in the device. The three chambers are recognizable outside by a connecting pipe or a connecting opening 2 preferably of a circular cross-section provided for each chamber. The connecting openings are advantageously arranged in a housing cover 3. Thereby the tanks or chambers are accessible by removing the device cover 3 which can be removed for example for cleaning. The device 1 is designed so that the filling of the chambers with the respective treatment liquids is performed with connection valves 4 insertable into the connecting openings. The connection valves 4 are arranged on canister or bottle-like supply containers 5 which are identical relative to the device connections. The supply containers 5 are introduced with a downwardly directed connection valve 4 to the connection openings 2, as can be clearly seen from FIG. 1.

The devices of this type are advantageous since they are favorable in view of the environmental protection, and also because of their simple exchange of the bottles 5 for the supply of the treatment liquids which can be easily managed by unskilled personnel. When the material quantities to be developed have a certain volume, the supply bottles 5 must be exchanged too often. Therefore, instead of the bottles 5 with the connection valves 4, a supply device for the treatment liquid exchangeable with the bottles 5 is to be used. It is formed as a connecting piece which is connectable with the device 1 for greater supply containers which are not shown in the drawings and from which the treatment liquids are pumped to the device chambers when needed. These high volume containers can be formed in any shape and arranged at a suitable location in a space. The supply arrangement has a housing 6 which is identified in a broken line. The connection between the supply arrangement and the associated high volume containers is performed by aspiration conduits 7.

The supply arrangement 6 has a bottom plate 6a and a plurality of supply pipes 8 connectable with the connection openings 2 of the device 1. Moreover, each supply pipe 8 has a suction pump 9 formed for example as a diaphragm pump and arranged in the housing 6 of the supply arrangement. The pumps are driven by a joint electric motor 10. Each of the pumps 9 is connected with one of the aspiration conduits 7. A supply conduit 11 extends from each pump 9 in and through the associated supply pipe 8. Therefore by inserting a supply pipe 8 in one of the connection openings 2 of the device 1, the treatment liquid aspirated by the associated pump 9 from the high volume supply container in which the associated aspiration conduit 7 is inserted, is pumped into the chamber in with the supply opening 2 for the supply pipe 8.

For turning on of the motor 10, two level probes 12 are provided in each supply pipe 8. Their tips end at the same height. When after the mounting of the supply arrangement on the device 1 the liquid in one of the chambers does not reach the tips of the probes 12, then they are not connected with one another in a current conductive manner. Electrical conductors 12 lead from all probes 12 to a control device 14. When the current conductive connection between one pair of the probes 12 is interrupted, then the electric motor 10 is turned on by the control device 14. As a result, all pumps 9 are put into operation until the liquid level reaches the required value in all chambers. Then the electric motor 10 is again turned off through the probes 12. If the liquid level is too low only in one of the chambers and the motor 10 is turned on, in the other sufficiently filled chambers the respective treatment liquid will be filled. If the pumped liquid quantity is, however, too high, it flows into the associated not shown recovery conduit or bath. Naturally, also other control elements different from the level probe 12 can be used.

For placing the supply arrangement without difficulties on the device 1, the connection openings 2 and the supply pipes 8 have such a spatial position on the upper side of the device or on the lower side 6a of the arrangement and the diameter of the supply pipes 8 are smaller than the corresponding connection openings 2, so that each supply pipe 8 is engaged in one connection opening 2 during placement of the supply arrangement 6 on the device 1 from above and automatically instead of the bottle 5. The axial distances of the supply pipes 8 are shown in FIG. 1 greater than the axial distances between the connection openings 2 only for the reason of simplicity of the drawings. In the practically designed arrangement 6 and the associated device 1 these axial distances are identical. When they are not identical for some reasons, the arrangement 6 must be provided with knee pieces 15 shown in broken lines on the supply pipes 8. The probes 12 and the supply conduits 11 are passed through the knee pieces. Such knee pieces can also be formed adjustably for adapting to different devices.

Furthermore it is advantageous that a central switch 16 is arranged on the bottom plate 6a of the arrangement and connected with the control device 14. After the placing of the supply arrangement 6 on the device 1, or in other words, after the engaging of the probes 12 to the chambers, the electric motor 10 is turned by the control device 14.

With the use of the diaphragm pumps 9 a pump arrangement disclosed in the German reference DE-PS No. 2,931,050 can be used for small size and a simple pump operation. With this approach all pumps 9 are supported on a holder 17. The eccentric cams 18 are driven from the single electric motor 10 and act one after the other on a spring-biased working plunger 19 of the pumps 9 to actuate the latter.

It will be understood that each of the elements described above, or two or more together, may also find a useful application in other types of constructions differing from the types described above.

While the invention has been illustrated and described as embodied in a supply arrangement for supplying treatment liquids to wet treatment devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A supply arrangement for supplying several treatment liquids to a wet treatment device for photographic material provided with a plurality of treatment tanks having connection openings, the supply arrangement comprising a plurality of supply pipes each connectable with a respective one of the supply openings of the treatment tanks; a plurality of aspiration pumps each connected with a respective one of said supply pipes; a single electric motor which drives said aspiration pumps; and a plurality of aspiration conduits connected to said pumps and each extending outside so as to be each connectable to a respective one of a supply container for treatment liquid.

2. A supply arrangement as defined in claim 1, wherein said supply pipes and the connection openings have such a spatial position on a lower side of the arrangement and the diameters of the supply pipes are smaller than those of the connecting openings, so that each of said supply pipes can engage a respective one of the connection openings during placing the supply arrangement on the device.

3. A supply arrangement as defined in claim 2; further comprising a bottom plate defining the lower side of the arrangement, said spatial position of said supply pipes is provided on said bottom plates.

4. A supply arrangement as defined in claim 1; and further comprising measuring probes for determining filling condition arranged in said supply pipes and projecting downwardly beyond a lower side of the arrangement.

5. A supply arrangement as defined in claim 4; and further comprising a bottom plate, said measuring probes projecting downwardly beyond said bottom plate.

6. A supply arrangement as defined in claim 1; and further comprising a plurality of supply conduits, each extending from a respective one of said aspiration pumps.

7. A supply arrangement as defined in claim 4; and further comprising a switch for an electric motor, and a further main switch which is closeable upon placing the supply arrangement on the device, and a control unit, said measuring probes, said switch for said electric motor, and said main switch being connected with said control unit so that said electric motor is turned on in response to sinking the treatment liquid level in one of the treatment tanks under the level of the associated measuring probes.

8. A supply arrangement as defined in claim 1, wherein said aspiration pumps are formed as diaphragm pumps; and further comprising a holder on which said diaphragm pumps are arranged.

9. A supply arrangement as defined in claim 8, wherein each of said aspiration pumps is provided with a working plunger; and further comprising rotatable eccentric cams which are turnable by said electric motor and actuating said working plungers of said suction pumps.

10. A supply arrangement as defined in claim 9, wherein said working plungers of said aspiration pumps are spring biased.

11. A wet treatment installation, comprising a wet treatment device for photographic material having a plurality of treatment tanks in which the material is transported, and a plurality of connection openings provided each in a respective one of said tanks; and a supply arrangement including a plurality of supply pipes each connectable with a respective one of the connection openings of the treatment tanks, a plurality of aspiration pumps each connected with a respective one of said supply pipes, a single electric motor which drives said aspiration pumps, and a plurality of aspiration conduits connected to said pumps and each extending outside so as to be each connectable to a respective one of a supply container for treatment liquid.

* * * * *